US011396873B2

(12) United States Patent
Bao et al.

(10) Patent No.: US 11,396,873 B2
(45) Date of Patent: Jul. 26, 2022

(54) SCROLL COMPRESSOR COMPRISING A VALVE PROVIDED ON A FIXED SCROLL THAT OPENS AT A CERTAIN PRESSURE

(71) Applicant: Danfoss (Tianjin) Ltd., Tianjin (CN)

(72) Inventors: Changqiao Bao, Tianjin (CN); Kun Qian, Tianjin (CN); Wenhu Yao, Tianjin (CN); Xueyou Zhou, Tianjin (CN); Gang Yao, Tianjin (CN); Zaiwang Wang, Tianjin (CN); Quanping Lei, Tianjin (CN)

(73) Assignee: DANFOSS (TIANJIN) LTD., Tianjin (CN)

( * ) Notice: Subject to any disclaimer, the term of this patent is extended or adjusted under 35 U.S.C. 154(b) by 0 days.

(21) Appl. No.: 17/132,969

(22) Filed: Dec. 23, 2020

(65) Prior Publication Data

US 2021/0199111 A1 Jul. 1, 2021

(30) Foreign Application Priority Data

Dec. 27, 2019 (CN) ..... 201911354394.X

(51) Int. Cl.
*F04C 2/02* (2006.01)
*F04C 18/02* (2006.01)
(Continued)

(52) U.S. Cl.
CPC ..... *F04C 2/025* (2013.01); *F04C 18/0215* (2013.01); *F04C 18/0253* (2013.01);
(Continued)

(58) Field of Classification Search
CPC ..... F04C 2/025; F04C 18/0207–0292; F04C 1/0207–1/0292; F04C 28/24–265; F04C 29/12–126
See application file for complete search history.

(56) References Cited

U.S. PATENT DOCUMENTS

2002/0071773 A1 6/2002 Matsuba et al.
2011/0058972 A1* 3/2011 Patel ..... F04C 23/008 418/16

FOREIGN PATENT DOCUMENTS

CN 1702328 A 11/2005
CN 102269165 A 12/2011
(Continued)

*Primary Examiner* — Laert Dounis
(74) *Attorney, Agent, or Firm* — McCormick, Paulding & Huber PLLC

(57) ABSTRACT

Embodiments of the present disclosure provide a scroll compressor. The scroll compressor includes: a fixed scroll having an end plate and a fixed scroll wrap extending from the end plate; an orbiting scroll having an orbiting scroll wrap, the orbiting scroll wrap being engaged with the fixed scroll wrap to form a plurality of compression chambers for compressing a medium; a channel formed in the end plate of the fixed scroll, the channel leading to one compression chamber of the plurality of compression chambers; and a valve provided on the end plate of the fixed scroll, and configured to open when a pressure in the one compression chamber is higher than a predetermined pressure threshold so as to allow the medium in the one compression chamber to flow out of the one compression chamber through the channel. The scroll compressor according to the embodiments of the present disclosure, for example, can improve the performance of the scroll compressor.

9 Claims, 6 Drawing Sheets

(51) Int. Cl.
*F04C 28/24* (2006.01)
*F04C 29/12* (2006.01)

(52) U.S. Cl.
CPC ..... *F04C 28/24* (2013.01); *F04C 29/12* (2013.01); *F04C 29/126* (2013.01)

(56) References Cited

FOREIGN PATENT DOCUMENTS

| | | | | | |
|---|---|---|---|---|---|
| CN | 104061155 | A | | 9/2014 | |
| CN | 109340117 | A | * | 2/2019 | |
| CN | 109340117 | A | | 2/2019 | |
| CN | 208793221 | U | | 4/2019 | |
| CN | 209414146 | U | | 9/2019 | |
| DE | 3438262 | C2 | * | 9/1988 | ..... F04C 18/0215 |
| JP | S63-134894 | A | | 6/1988 | |
| JP | H0245674 | A | | 2/1990 | |
| JP | H0281982 | A | | 3/1990 | |
| JP | 2017053302 | A | | 3/2017 | |
| KR | 20000008929 | A | * | 2/2000 | |
| KR | 20060074489 | A | | 7/2006 | |
| KR | 20090095381 | A | * | 9/2009 | |
| KR | 20140012858 | A | * | 2/2014 | |

* cited by examiner

SCROLL COMPRESSOR COMPRISING A VALVE PROVIDED ON A FIXED SCROLL THAT OPENS AT A CERTAIN PRESSURE

CROSS-REFERENCE TO RELATED APPLICATION

This application claims foreign priority benefits under 35 U.S.C. § 119 to Chinese Patent Application No. 201911354394.X filed on Dec. 27, 2019, the content of which is hereby incorporated by reference in its entirety.

BACKGROUND OF THE INVENTION

Technical Field

Embodiments of the present disclosure relate to a scroll compressor.

Background

A scroll compressor includes a fixed scroll and an orbiting scroll. The fixed scroll has an end plate and a fixed scroll wrap extending from the end plate. The orbiting scroll has an orbiting scroll wrap, and the orbiting scroll wrap and the fixed scroll wrap are engaged with each other to form a compression chamber for compressing a medium. When the compressor is working, if the refrigerant liquid or wet vapor is sucked into the compressor by the compressor, because the liquid is incompressible, the liquid sucked into the compressor will have a great impulsive force on the scroll wraps. The scrolls may be broken, which may damage the compressor and cause the compressor to no longer work.

SUMMARY

An object of embodiments of the present disclosure is to provide a scroll compressor, thereby, for example, improving the performance of the scroll compressor, and especially the resistance to liquid impact.

Embodiments of the present disclosure provide a scroll compressor. The scroll compressor includes: a fixed scroll having an end plate and a fixed scroll wrap extending from the end plate; an orbiting scroll having an orbiting scroll wrap, the orbiting scroll wrap being engaged with the fixed scroll wrap to form a plurality of compression chambers for compressing a medium; a channel formed in the end plate of the fixed scroll, the channel leading to one compression chamber of the plurality of compression chambers; and a valve provided on the end plate of the fixed scroll, and configured to open when a pressure in the one compression chamber is higher than a predetermined pressure threshold so as to allow the medium in the one compression chamber to flow out of the one compression chamber through the channel.

According to embodiments of the present disclosure, the valve comprises: a valve seat provided on a side of the fixed scroll away from the fixed scroll wrap, an opening of the channel being formed in the valve seat; a valve element configured to open and close the opening of the channel; and a spring configured to apply a pushing force to the valve element toward the valve seat.

According to embodiments of the present disclosure, the valve further comprises: a fixing member fixed on a side of the fixed scroll away from the fixed scroll wrap, the fixing member having: a first side face and a second side face opposite to each other, and a hole extending from the first side face toward the second side face to between the first side face and the second side face, wherein the valve element and the spring are provided in the hole of the fixing member.

According to embodiments of the present disclosure, the fixing member further has an opening extending from the first side face in an axial direction of the hole to expose a part of the hole, and a width of the opening is smaller than a diameter of the hole.

According to embodiments of the present disclosure, the fixing member has two said openings, and the two openings face each other in a direction perpendicular to the axial direction of the hole.

According to embodiments of the present disclosure, the valve element has: a first side face and a second side face opposite to each other, and a hole extending from the first side face toward the second side face to between the first side face and the second side face, wherein an end of the spring is inserted into the hole of the valve element.

According to embodiments of the present disclosure, the fixed scroll further has a protrusion protruding from a side of the end plate away from the fixed scroll wrap, and the valve seat is provided in a side face of the protrusion.

According to embodiments of the present disclosure, the fixed scroll further has a protrusion protruding from a side of the end plate away from the fixed scroll wrap, and the valve seat is provided in a side face of the protrusion, and the fixed scroll further has a recess on the side of the end plate away from the fixed scroll wrap, and the fixing member is provided in the recess.

According to embodiments of the present disclosure, the fixed scroll further has a protrusion protruding from a side of the end plate away from the fixed scroll wrap, and the valve seat is provided in a side face of the protrusion, and the first side face of the fixing member and the side face of the protrusion abut against each other.

According to embodiments of the present disclosure, the side face of the protrusion extends along an axial direction of the fixed scroll, and the fixing member is spaced apart from a bottom face of the recess.

According to embodiments of the present disclosure, the one compression chamber of the plurality of compression chambers is a radially outermost compression chamber of the plurality of compression chambers.

The scroll compressor according to the embodiments of the present disclosure, for example, can improve the performance of the scroll compressor.

DETAILED DESCRIPTION

Figure 1:
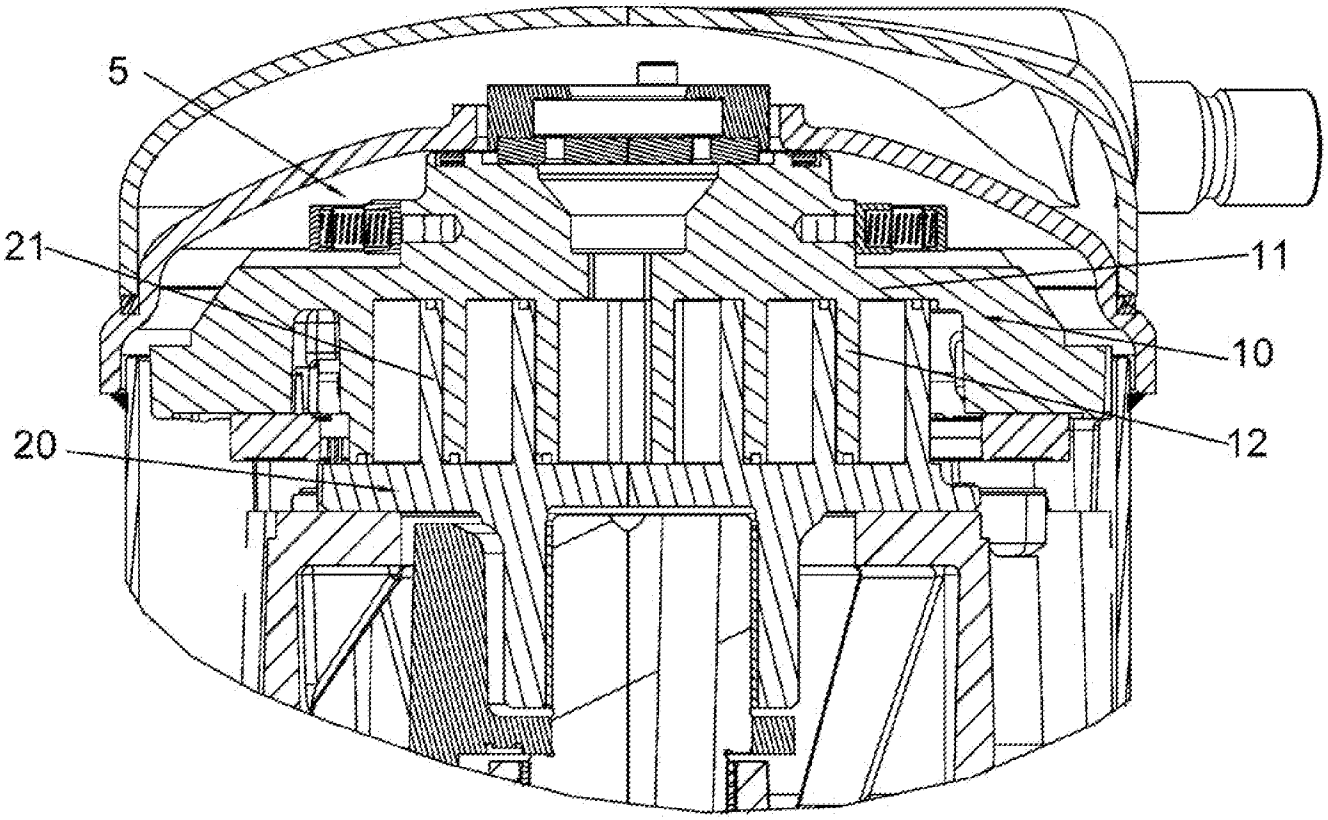
FIG. 1 is a schematic partial cross-sectional view of a scroll compressor according to an embodiment of the present disclosure.

The embodiments of the present disclosure will be described below in conjunction with the drawings.

Referring to FIGS. 1 to 6, the scroll compressor according to the embodiments of the present disclosure includes: a fixed scroll 10, an orbiting scroll 20, a channel 6, and a valve 5. The fixed scroll 10 has an end plate 11 and a fixed scroll wrap 12 extending from the end plate 11. The orbiting scroll 20 has an orbiting scroll wrap 21. The orbiting scroll wrap 21 and the fixed scroll wrap 12 are engaged with each other to form a plurality of compression chambers 3 for compressing a medium. The channel 6 is formed in the end plate 11 of the fixed scroll 10, and the channel 6 leads to one compression chamber 3 of the plurality of compression chambers 3. The valve 5 is provided on the end plate 11 of the fixed scroll 10 and is configured to open when the pressure in the compression chamber 3 is higher than the predetermined pressure threshold so as to allow the medium in the compression chamber 3 to flow out of the compression chamber 3 through the channel 6. The compression chamber 3 may be the radially outermost compression chamber 3 of the plurality of compression chambers 3. The predetermined pressure threshold may be set according to the difference between the pressure in the compression chamber 3 corresponding to the valve 5 and the pressure at the inlet of the scroll compressor.

Figure 2:
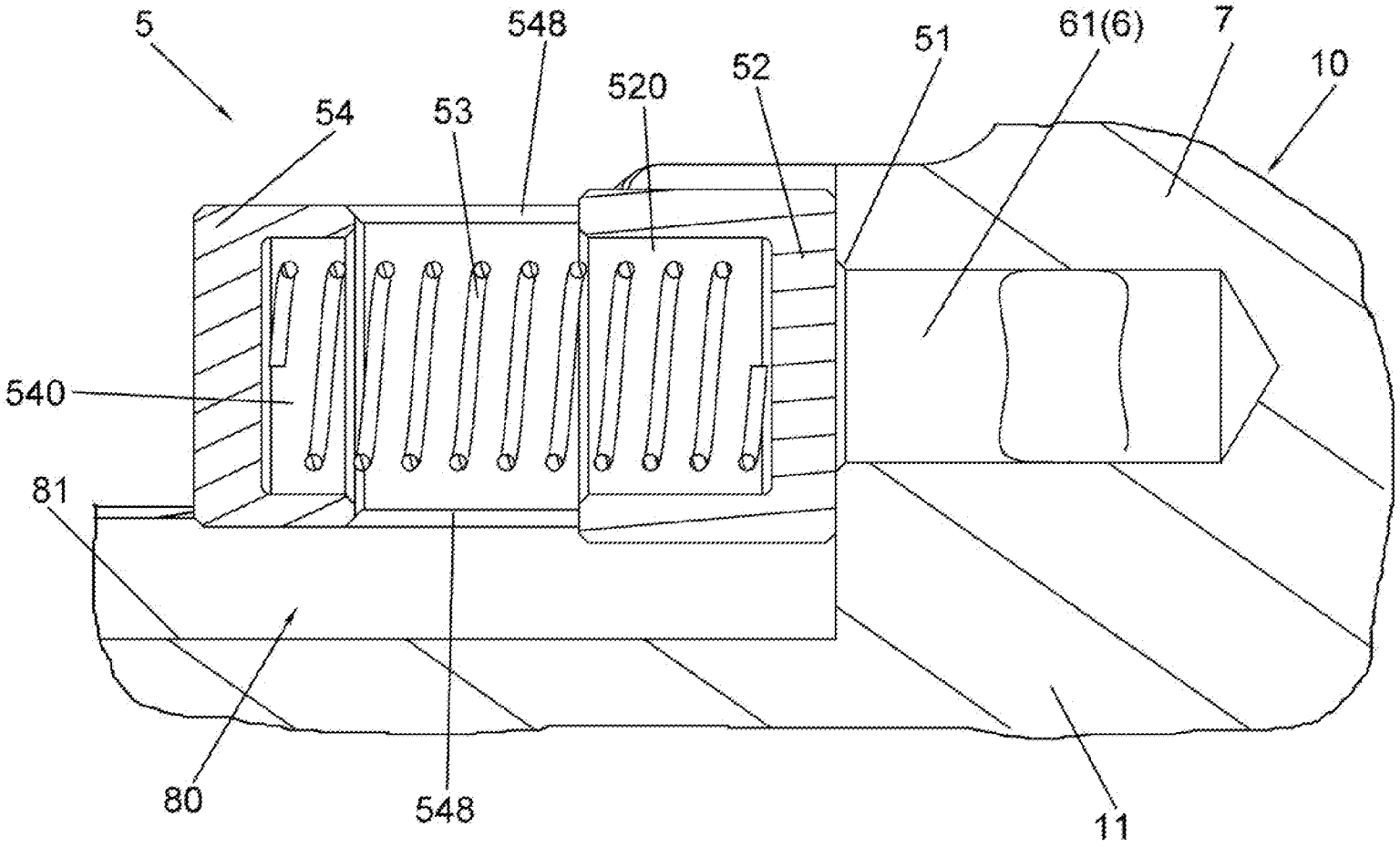
FIG. 2 is a partial enlarged cross-sectional view of a valve and related parts shown in FIG. 1.
Figure 3:
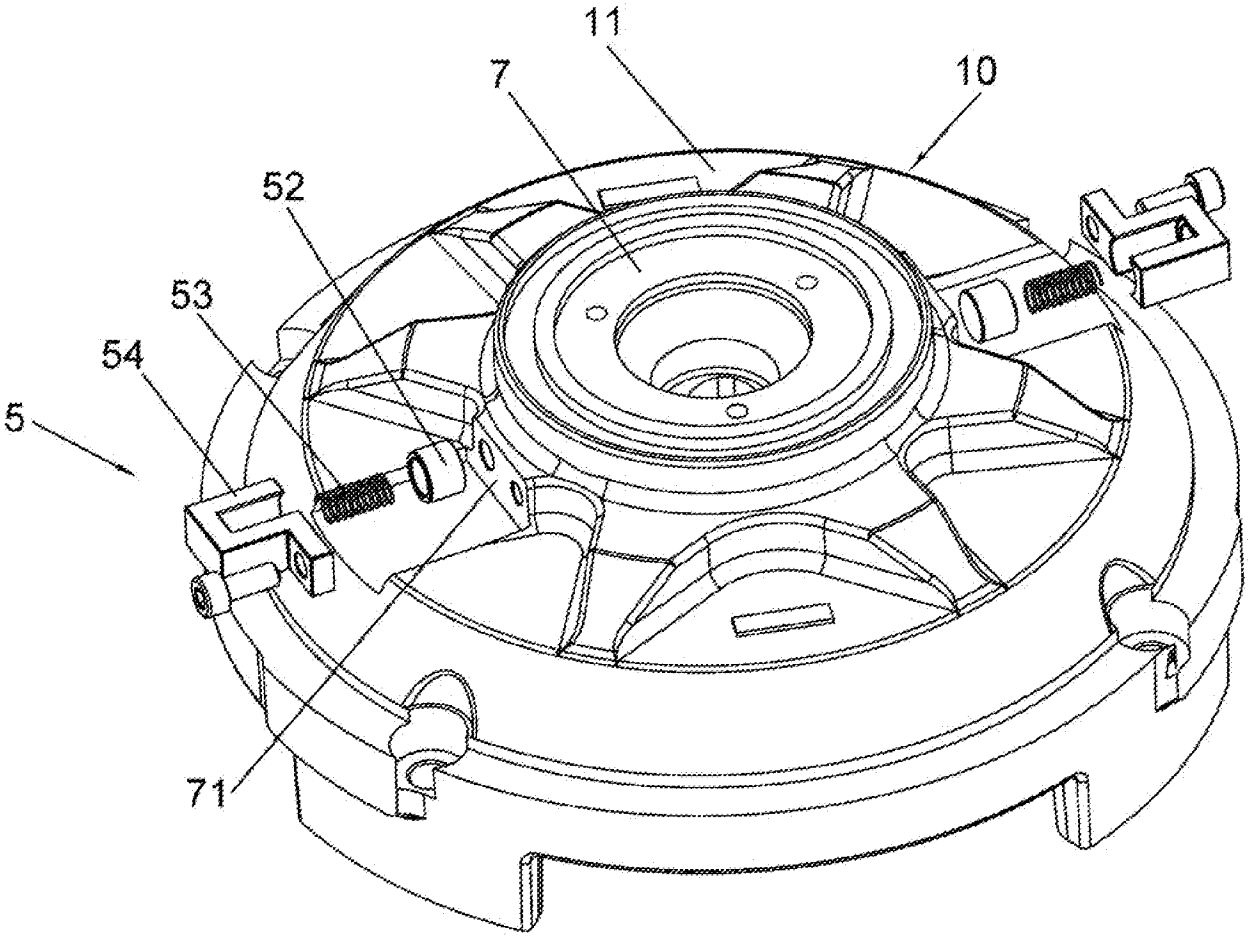
FIG. 3 is a schematic perspective view of a part of the scroll compressor shown in FIG. 1.
Figure 4:
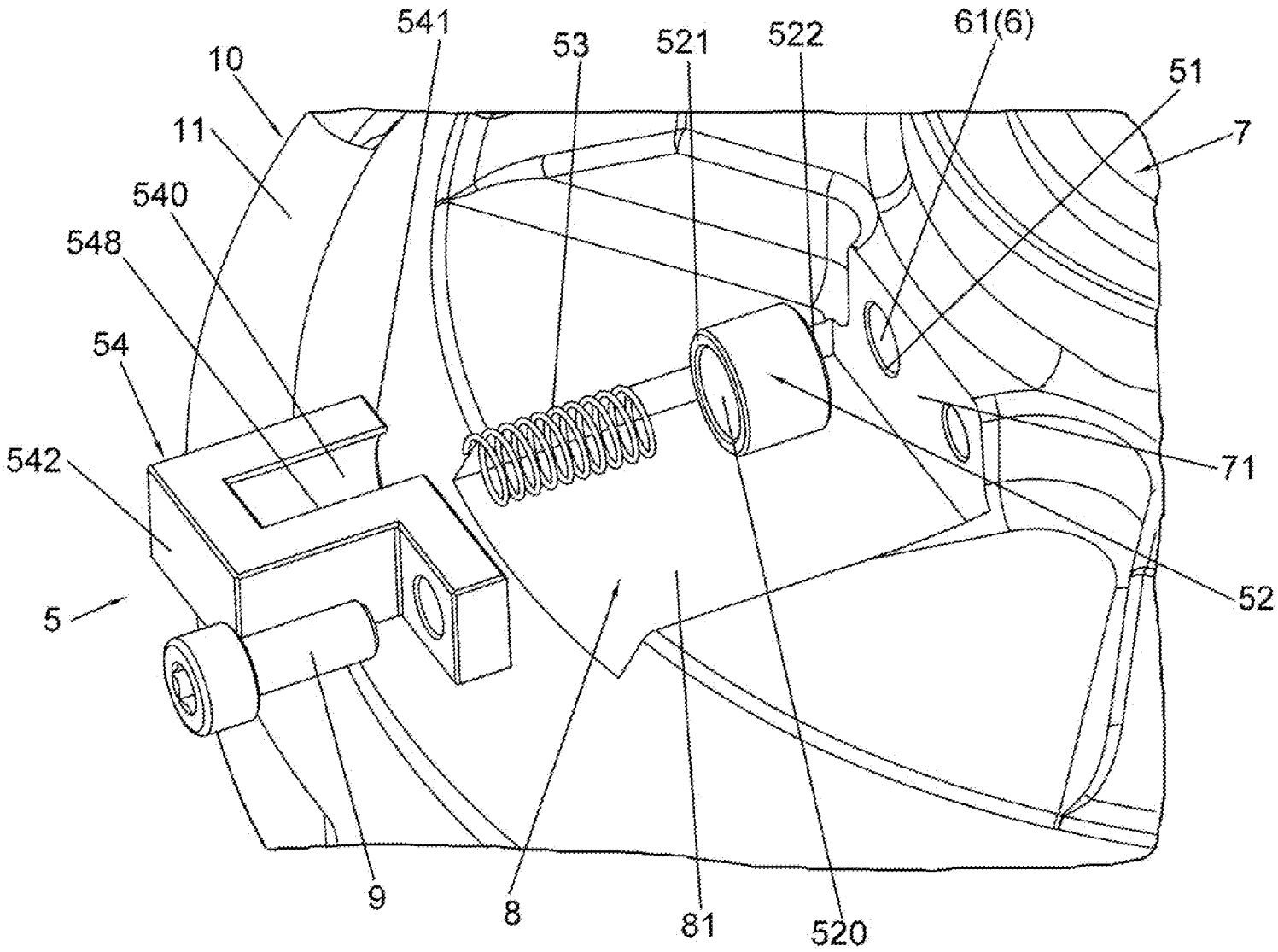
FIG. 4 is a partially enlarged perspective view of the valve and related parts shown in FIG. 3.
Figure 5:
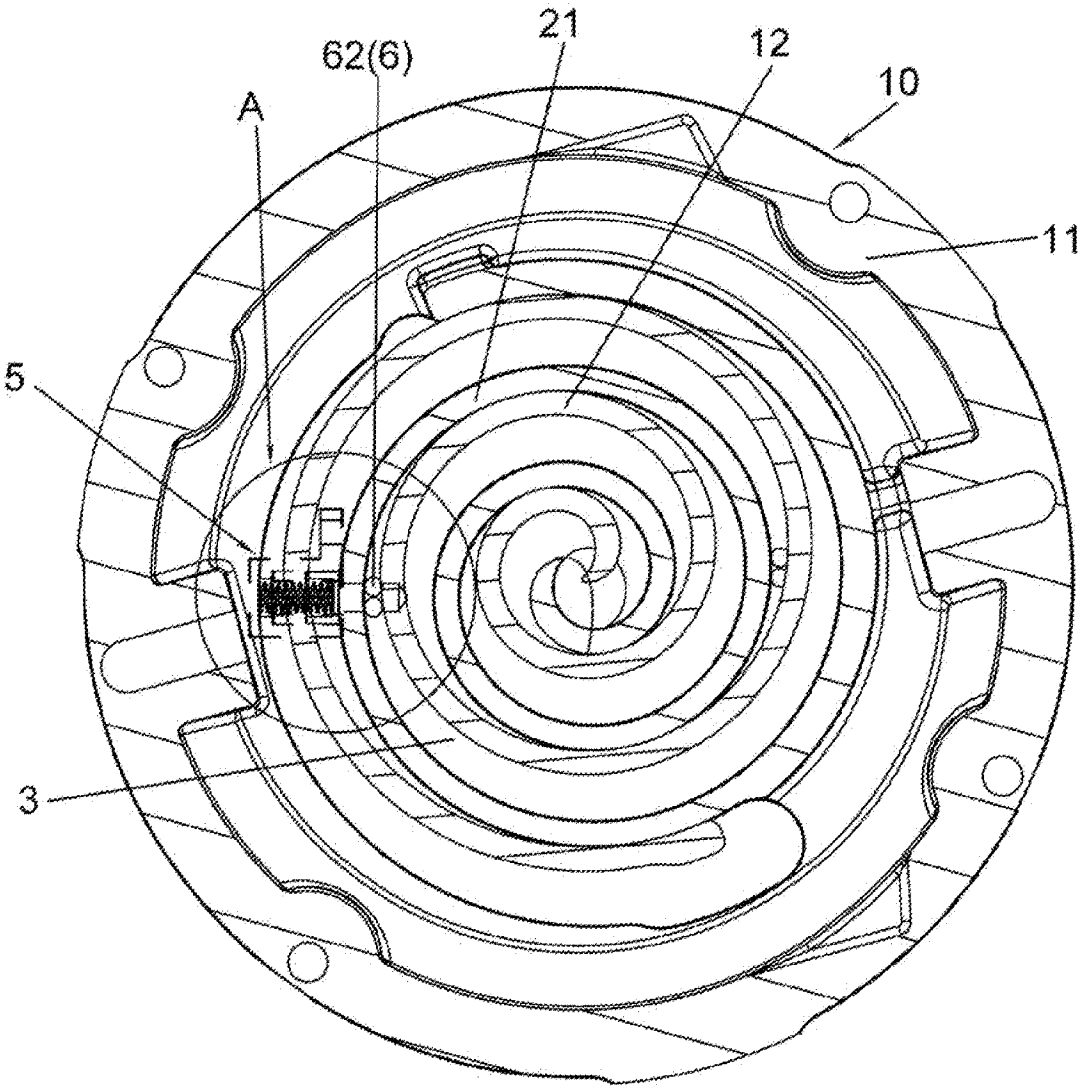
FIG. 5 is a cross-sectional view of the scroll compressor shown in FIG. 1.
Figure 6:
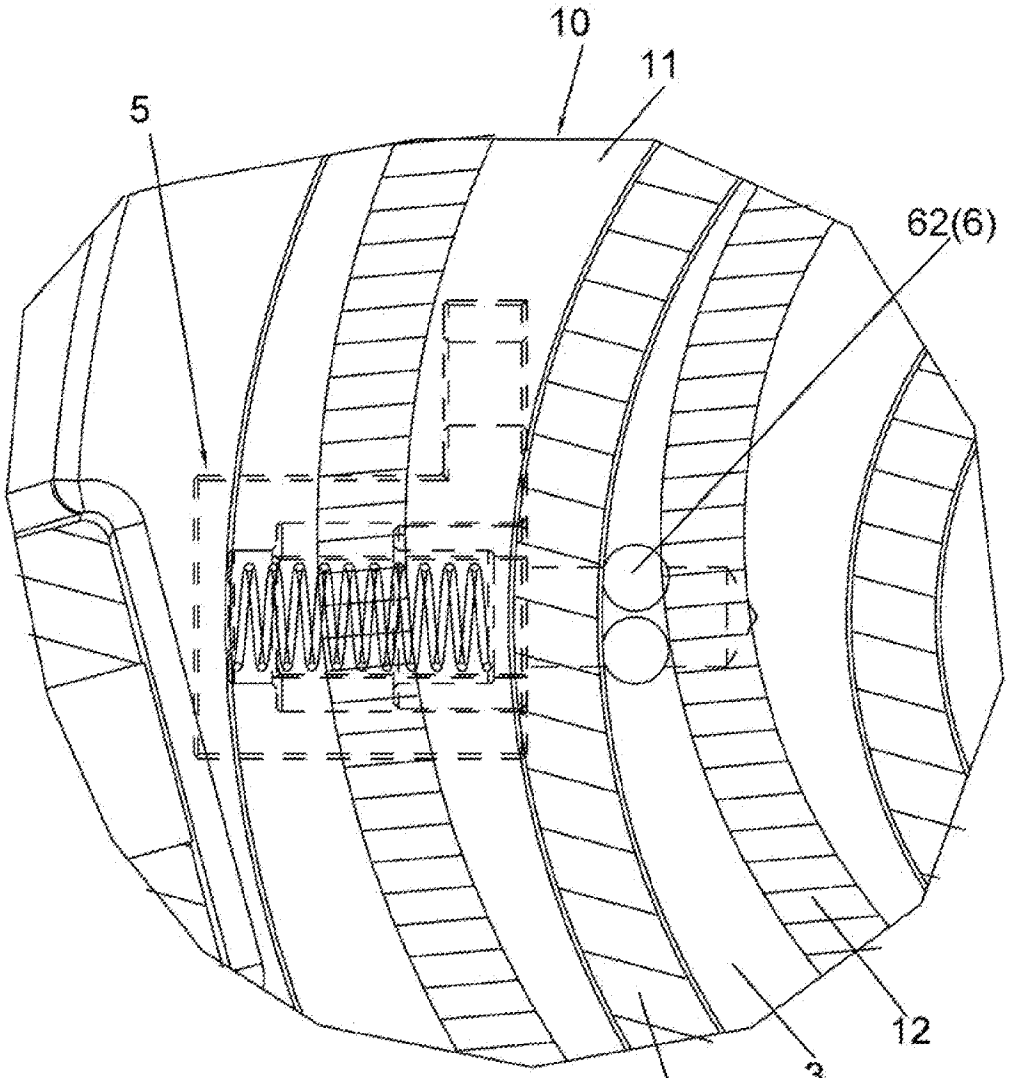
FIG. 6 is a partially enlarged cross-sectional view of the part A (the valve and related parts) shown in FIG. 5.

Referring to FIGS. 2 to 4, in the embodiments of the present disclosure, the valve 5 includes: a valve seat 51, a valve element 52, and a spring 53. The valve seat 51 is arranged on the side of the fixed scroll 10 away from the fixed scroll wrap 12, and an opening of the channel 6 is formed in the valve seat 51. The valve element 52 is configured to open and close the opening of the channel 6. The spring 53 is configured to apply a pushing force to the valve element 52 towards the valve seat 51. The elastic force of the spring 53 is selected according to the aforementioned predetermined pressure threshold, so that when the pressure in the compression chamber 3 corresponding to the valve 5 is higher than the elastic force of the spring 53, the spring 53 is pushed away by the medium flow in the channel 6, so that the valve 5 is opened. Thereby, the medium in the compression chamber 3 flows out of the compression chamber 3 through the channel 6. The medium is, for example, refrigerant liquid or refrigerant vapor.

Referring to FIGS. 2 to 4, in the embodiments of the present disclosure, the valve 5 further includes a fixing member 54 fixed on the side of the fixed scroll 10 away from the fixed scroll wrap 12. The fixing member 54 has a first side face 541 and a second side face 542 opposite to each other, and a hole 540 extending from the first side face 541 toward the second side face 542 to between the first side face 541 and the second side face 542. The valve element 52 and the spring 53 are movably provided in the hole 540 of the fixing member 54. According to an example of the present disclosure, the fixing member 54 further has an opening 548 extending from the first side face 541 in the axial direction of the hole 540 to expose a part of the hole 540. The width of the opening 548 is smaller than the diameter of the hole 540. The fixing member 54 may have two openings 548, and the two openings 548 face each other in a direction perpendicular to the axial direction of the hole. For example, the two openings 548 are respectively in the top face and bottom face of the fixing member 54.

Referring to FIGS. 2 to 4, in the embodiments of the present disclosure, the valve element 52 has a first side face 521 and a second side face 522 opposite to each other, and a hole 520 extending from the first side face 521 toward the second side face 522 to between the first side face 521 and the second side face 522. An end of the spring 53 is inserted into the hole 520 of the valve element 52.

Referring to FIGS. 2 to 4, in the embodiments of the present disclosure, the fixed scroll 10 further has a protrusion 7 protruding from the side of the end plate 11 away from the fixed scroll wrap 12, and the valve seat 51 is provided in the side face 71 of the protrusion 7. The first side face 541 of the fixing member 54 and the side face 71 of the protrusion 7 may abut against each other. The fixing member 54 may be fixed to the side face 71 of the protrusion 7 of the fixed scroll 10 by screws 9 (see FIG. 4). The fixing member 54 may also be fixed to the side face 71 of the protrusion 7 of the fixed scroll 10 by other means.

Referring to FIGS. 2 to 4, in the embodiments of the present disclosure, the fixed scroll 10 further has a recess 8 on the side of the end plate 11 away from the fixed scroll wrap 12, and the fixing member 54 is provided in the recess 8. The side face 71 of the protrusion 7 extends along the axial direction of the fixed scroll 10, and the fixing member 54 is spaced apart from the bottom face 81 of the recess 8. The bottom face 81 of the recess 8 may be perpendicular to the axial direction of the fixed scroll 10. For example, when being in use, the side face 71 of the protrusion 7 can extend in the vertical direction, and the bottom face 81 of the recess 8 can extend in the horizontal direction.

Referring to FIGS. 2 to 5, in the embodiments of the present disclosure, the channel 6 includes a first hole 61 extending in the protrusion 7 and a second hole 62 extending from the protrusion 7 toward the side of the end plate 11 away from the protrusion 7 and passing through the end plate 11. The first hole 61 is in communication with the second hole 62. For example, the first hole 61 extends in the protrusion 7 in a direction perpendicular to the axial direction of the fixed scroll 10, and the second hole 62 extends from the protrusion 7 in the axial direction of the fixed scroll 10 toward the side of the end plate 11 away from the protrusion 7 and passes through the end plate 11. The second hole 62 leads to the compression chamber 3. The position of the second hole 62 is at a distance of a predetermined angle from the position where the orbiting scroll wrap 21 and the fixed scroll wrap 12 start a compression, for example, 281 degrees to 301 degrees, for example, about 291 degrees. The second hole 62 may include two holes 62.

The scroll compressor according to the embodiments of the present disclosure, for example, can improve the resistance to liquid impact of the scroll compressor.

In addition, in the scroll compressor according to the embodiments of the present disclosure, the valve 5 is used. Therefore, when the liquid medium is sucked in the scroll compressor, since the pressure in the compression chamber 3 will be higher than the predetermined pressure threshold, the valve 5 is opened to allow the medium in the compression chamber 3 to flow out of the compression chamber 3 through the channel 6.

Since the channel 6 leads to the radially outermost compression chamber 3, that is, the compression chamber 3 in the medium suction port region, when the liquid medium is sucked in the scroll compressor, the liquid medium can be discharged in time to prevent damage to the compressor.

Although the above embodiments are described, some features in the above embodiments can be combined to form new embodiments.

What is claimed is:

1. A scroll compressor comprising:

a fixed scroll having an end plate and a fixed scroll wrap extending from the end plate;

an orbiting scroll having an orbiting scroll wrap, the orbiting scroll wrap being engaged with the fixed scroll wrap to form a plurality of compression chambers for compressing a medium;

a channel formed in the end plate of the fixed scroll, the channel leading to one compression chamber of the plurality of compression chambers; and a valve provided on the end plate of the fixed scroll, and configured to open when a pressure in the one compression chamber is higher than a predetermined pressure threshold so as to allow the medium in the one compression chamber to flow out of the one compression chamber through the channel, wherein the valve comprises:

a valve seat provided on a side of the fixed scroll away from the fixed scroll wrap, an opening of the channel being formed in the valve seat;

a valve element configured to open and close the opening of the channel;

a spring configured to apply a pushing force to the valve element toward the valve seat; and a fixing member fixed on a side of the fixed scroll away from the fixed scroll wrap, the fixing member having: a first side face and a second side face opposite to each other; and a hole extending from the first side face toward the second side face to between the first side face and the second side face, wherein the valve element and the spring are provided in the hole of the fixing member; and the fixed scroll further has a protrusion protruding from a side of the end plate away from the fixed scroll wrap, and the valve seat is provided in a side face of the protrusion.

2. The scroll compressor according to claim 1, wherein: the fixing member further has an opening extending from the first side face in an axial direction of the hole to expose a part of the hole, and a width of the opening is smaller than a diameter of the hole.

3. The scroll compressor according to claim 2, wherein: the opening extending in the axial direction of the hole comprises two openings facing each other in a direction perpendicular to the axial direction of the hole.

4. The scroll compressor according to claim 1, wherein the valve element has:

a first side face and a second side face opposite to each other, and a hole extending from the first side face toward the second side face to between the first side face and the second side face, wherein an end of the spring is inserted into the hole of the valve element.

5. The scroll compressor according to claim 1, wherein: the fixed scroll further has a recess on the side of the end plate away from the fixed scroll wrap, and the fixing member is provided in the recess.

6. The scroll compressor according to claim 1, wherein: the first side face of the fixing member and the side face of the protrusion abut against each other.

7. The scroll compressor according to claim 5, wherein: the side face of the protrusion extends along an axial direction of the fixed scroll, and the fixing member is spaced apart from a bottom face of the recess.

8. The scroll compressor according to claim 1, wherein: the one compression chamber of the plurality of compression chambers is a radially outermost compression chamber of the plurality of compression chambers.

9. The scroll compressor according to claim 6, wherein: the side face of the protrusion extends along an axial direction of the fixed scroll, and the fixing member is spaced apart from a bottom face of the recess.

* * * * *